US005992414A

United States Patent [19]

Tayebi et al.

[11] Patent Number: 5,992,414

[45] Date of Patent: Nov. 30, 1999

[54] RESPIRATOR FILTER

[75] Inventors: Amad Tayebi, Westford; Ashish K. Mithal, Lowell; George S. Saati, Billerica, all of Mass.; Scott W. Cormier, Windham, N.H.

[73] Assignee: Mine Safety Appliances Company, Pittsburgh, Pa.

[21] Appl. No.: 09/140,144

[22] Filed: Aug. 26, 1998

Related U.S. Application Data

[60] Provisional application No. 60/057,171, Aug. 26, 1997.

[51] Int. Cl.[6] ..... A62B 7/10

[52] U.S. Cl. ..... 128/205.27; 128/206.16

[58] Field of Search ..... 128/202.18, 205.27, 128/206.16, 205.29

[56] References Cited

U.S. PATENT DOCUMENTS

| | | | |
|---|---|---|---|
| 2,917,046 | 12/1959 | Fairbanks | 128/202.18 |
| 3,811,436 | 5/1974 | Ferrell | 128/205.29 |
| 3,815,754 | 6/1974 | Rosenberg | 128/205.29 |
| 3,920,009 | 11/1975 | Olsen | 128/205.29 |
| 4,248,220 | 2/1981 | White | 128/206.16 |
| 4,361,146 | 11/1982 | Woicke | 128/206.16 |
| 4,386,948 | 6/1983 | Choksi et al. | 128/205.29 |
| 4,402,317 | 9/1983 | Martin | 128/205.29 |
| 4,523,588 | 6/1985 | Dolsky | 128/202.18 |
| 4,898,164 | 2/1990 | Baumberg | 128/202.18 |
| 4,977,634 | 12/1990 | Koji | 128/205.27 |
| 5,038,431 | 8/1991 | Burgin et al. | 128/202.18 |
| 5,291,881 | 3/1994 | Drews et al. | 158/205.27 |
| 5,320,096 | 6/1994 | Hans | 128/205.29 |
| 5,357,947 | 10/1994 | Adler | 128/205.27 |
| 5,427,092 | 6/1995 | Shiao | 128/205.29 |
| 5,763,078 | 6/1998 | Braun et al. | 128/206.11 |

*Primary Examiner*—Aaron J. Lewis
*Attorney, Agent, or Firm*—James G. Uber

[57] ABSTRACT

A deformable, pad-type filter is provided which does not have a frame but instead uses two filter elements, at least one having a non-planar configuration in a stress-free condition, which are preferably joined along an outer edge to form an inner chamber. A connector is located in and attached to one of the filter elements, the connector having a rigid connector platform which projects radially outward from the connector to enable a user's fingers to grasp the perimeter of the connector platform to twist or otherwise manipulate the filter for connection or disconnection to a respirator facepiece without damage to the filter material.

20 Claims, 2 Drawing Sheets

RESPIRATOR FILTER

This application claims benefit of Provisional Application Ser. No. 60/057,171 filed Aug. 26, 1997.

FIELD OF THE INVENTION

The present invention relates generally to a flexible filter used with air-purifying respirators and more particularly to a pad-type filter that does not have a frame.

BACKGROUND OF THE INVENTION

Air-purifying respirators are worn on a user's face for protection against gases, vapors and particulates. They filter the air breathed by a user to remove the noxious gases, vapors and particulates while enabling oxygen in the atmosphere to reach the user. An air-purifying respirator typically consists of three parts: a facepiece, a filter, and a head harness. The facepiece can be a full mask, covering the entire face and forming a seal therewith; or it can be a half-mask, covering only the nose and mouth and forming a seal there-around. The head harness typically consists of a yoke with straps attached thereto. The yoke is attached to the facepiece such that when the straps are worn, the head harness keeps the facepiece sealed against the face. The filter is connected to the facepiece and removes the noxious substances from the air as it is inhaled into the facepiece. The facepiece also often includes an exhalation valve which permits expired air to be vented directly to the outside of the facepiece, but which remains closed during inhalation so that all inhaled air passes through the filter. Examples of typical air-purifying respirators are the Advantage® 200 half-mask respirator and the Advantage® 1000 full-mask respirator made by Mine Safety Appliances Company ("MSA") of Pittsburgh, Pa. and described in MSA Data Sheet No. 10-00-05 (1998) and MSA Bulletin No. 1012-06 (1998). The Advantage® 200 respirator is also shown and described in U.S. Pat. No. 5,592,937.

Respirator filters come in various shapes, sizes and materials. Some are in the form of rigid cartridges, such as disclosed in U.S. Pat. No. 5,714,126. Some are in the form of flexible filter pads, such as disclosed in U.S. Pat. No. Re. 35,062. Other's are somewhere in between such as the filter pad with a rigid perimeter such as disclosed in U.S. Pat. No. 5,732,695. These filters are the result of trade-offs between competing design considerations such as increased efficiency, lower breathing resistance and durability.

For example, in U.S. Pat. No. Re. 35,062, the filter consists of two filter pads secured along their outer edges to face in opposing directions. The filter pads are separated by a porous layer which forms an interior region in which the air may be drawn through the filter pads. A connector is provided through one of the pads to connect this interior region with the inlet valve of the respirator facepiece. As the user inhales, air is drawn through the surfaces of both filter pads into the porous layer and then through the connector into the facepiece via the inlet valve.

While this two-pad design is useful in reducing breathing resistance without significantly detracting from filtration efficiency, a need remains in the art to develop even better designs having improved performance and use characteristics. For instance, this flexible, pad-type filter is generally secured to and disconnected from the respirator facepiece by attaching the connector to the respirator using a threaded or bayonet-type fitting. In doing so, the user must grasp and touch the filter pads and twist or otherwise manipulate the filter to make the connection. This means that any soil on the user's hands can contaminate the filter pad thus reducing filtration efficiency. Moreover, in twisting or otherwise manipulating the filter pad for connection or disconnection with the respirator facepiece, the pliable filter material tends to be rotated or turned further than the relatively stiff connector to which it is attached, thereby placing stress on the filter material surrounding the connector. This relative rotational stress on the filter material can potentially lead to tearing or other damage of the material and possibly even separation of the filter material from the connector.

From the above it is clear that minimizing and even preventing user contact with the filter material, preventing bending of the filter material during removal and attachment, and preventing relative rotation between the filtration material and the connector are desirable objectives to enhance the overall performance and durability of a flexible pad-type filter. Of course, it is still necessary to maintain filtration efficiency while reducing breathing resistance, preferably by to increasing the overall filtering surface area while making the filter relatively compact so as not to obstruct the user's view or otherwise frustrate the user's ability to work when wearing the respirator.

The filter shown in U.S. Pat. No. 5,732,695 uses an internal rigid frame with an outer peripheral band to keep the filter pads separate and to overcome some of the problems discussed above with regard to preventing bending of the filter material during removal and attachment and preventing the relative rotation between the filter material and the connector. In doing so, however, this filter is no longer flexible, but is rigid.

It would be very desirable to overcome the attachment and rotation problems described above without having to sacrifice the flexibility of the pad-type filter. A flexible or deformable filter is a very desirable feature, especially since such a filter can easily fit under a welding shield by conforming to the shape of the shield as it is raised and lowered.

SUMMARY OF THE INVENTION

Generally the present invention relates to a flexible filter which does not require a frame or porous layer to keep the filter elements in a spaced-apart relationship so as to define an inner chamber. Preferably the deformable filter of the present invention comprises a first filter element having a non-planar configuration in a stress-free condition and a second filter element joined to the first filter element to create an inner chamber. The second filter element can be planar or it can also have a non-planar configuration in a stress-free condition. The first and second filter elements may have the same non-planar configuration although they preferably have different configurations. For example, one may have radial corrugations and the other longitudinal. Both filter elements are permeable to air and can be made from a plurality of filter materials.

The inner chamber is created by the non-planar configuration of the first and/or second filter elements. Preferably, the filter elements are preformed into the desired non-planar configuration using known molding, thermoforming or other processing techniques. When the two filter elements are superimposed on one another and joined along their perimeter, the non-planar configuration creates the inner chamber without the need for a frame or a separate porous layer. The inner chamber, however, can be filled with a filtration material such as activated carbon. Preferably the outer perimeter of each filter element has the same shape so that they can easily be joined together along their outer edge.

The perimeter can have any shape desired including, but not limited to, circular, oval, triangular or even tear-drop.

The filter also comprises a connector located in and attached to one of the filter elements. The connector has an opening therethrough to permit air to pass from the inner chamber to a respirator facepiece. The connector also has a rigid connector platform which projects radially outward from the connector. The connector platform is substantially parallel to and spaced apart from the filter elements to enable a user's fingers to grasp a perimeter of the connector platform to twist or otherwise manipulate the filter for connection or disconnection to a respirator facepiece without damage to the filter material.. The connector platform can be circular or other various noncircular shapes including oval and elliptical. Preferably the perimeter of the connector platform has a plurality of finger-gripping recesses located therein for ease of grasping by the user's fingers.

Other details, objects and advantages of the present invention will be readily apparent from the following description of a presently preferred embodiment thereof.

DESCRIPTION OF THE PREFERRED EMBODIMENT

Figure 1:
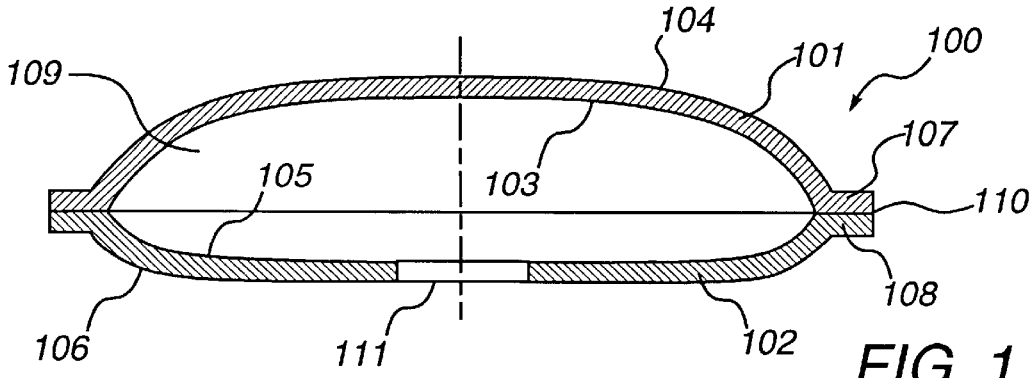
FIG. 1 is a cross-section of a filter of the present invention made from dome-shaped, preformed filter elements.
Figure 1A:
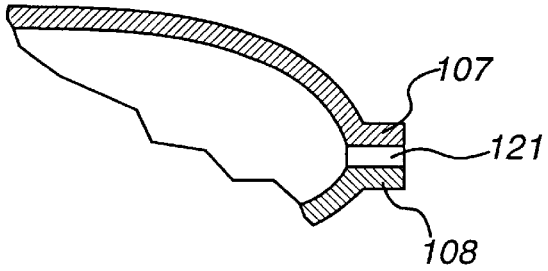

As shown in a cross-sectional view in FIG. 1, a first embodiment of the present invention is directed to a deformable filter 100 featuring a low resistance to flow by providing a first filter element 101 disposed substantially opposite to a similarly-shaped second filter element 102. First filter element 101 has an inner surface 103, an outer surface 104, and a perimeter 107. Second filter element 102 has an inner surface 105, an outer surface 106, and a perimeter 108. At least one of the first and second filter elements 101 and 102 is, in its stress-free condition, of a non-planar configuration. This may be accomplished by thermoforming, molding, or other processing techniques known in the art. Because of the stress-free, non-planar shape of either first filter element 101, second filter element 102, or both, an inner chamber 109 is created between and defined by inner surfaces 103 and 105 and perimeters 107 and 108. Perimeters 107 and 108 define an edge 110 impermeable to air, gas and vapor. Perimeters 107 and 108 may be joined together directly or by sandwiching a flexible or rigid perimeter element 121 as shown in FIG. 1-A. The air being filtered enters inner chamber 109 through outer surfaces 104 and 106 of first and second filter elements 101 and 102 and exits through at least one opening 111. Alternatively, the direction of flow of fluid being filtered may be reversed, that is, opening 111 provides an inlet for the fluid being filtered and filtration is accomplished by passing the fluid first through inner walls 103 and 105 of first and second filter elements 101 and 102.

Figure 2:
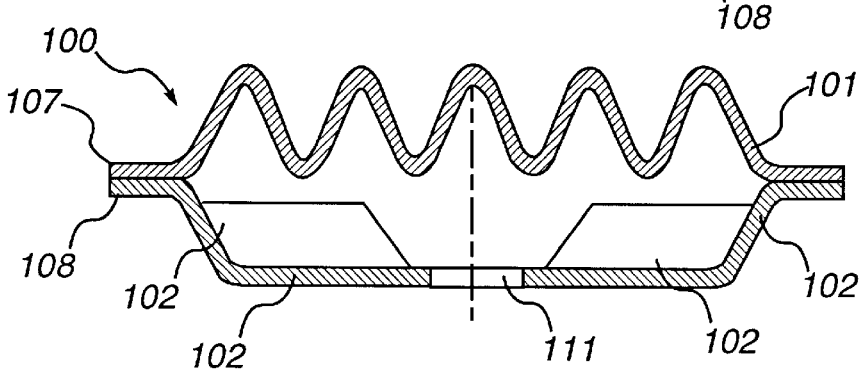
FIG. 2 is a cross-section of another embodiment of the present invention made from preformed filter elements having different shapes.
Figure 3:
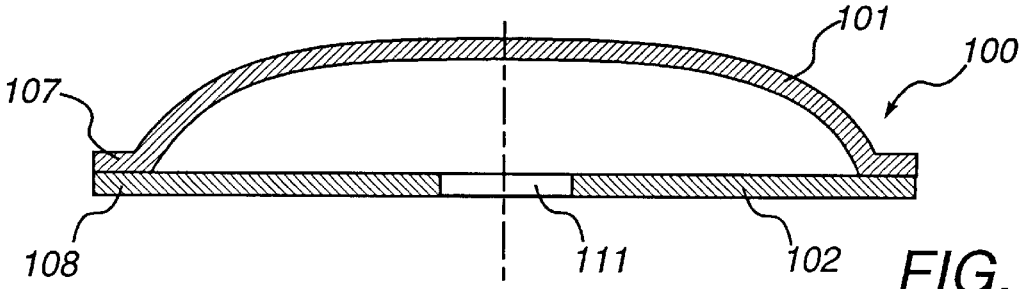
FIG. 3 is a cross-section of another embodiment of the present invention having one preformed filter element.
Figure 4:
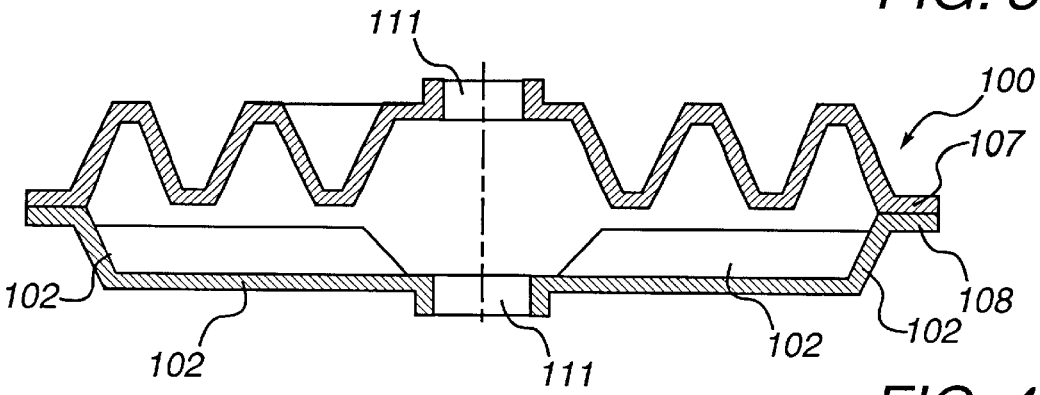
FIG. 4 is a cross-section of another embodiment of the present invention made from preformed filter elements having different shapes.

FIGS. 2, 3 and 4 show cross-sectional views of a variety of stress-free shapes of filter 100. As shown in FIG. 2, first filter element 101 has a stress-free shape in the form of longitudinal corrugations whereas second filter element 102 has a stress-free shape in the form of lateral corrugations. As shown in FIG. 3, first filter element 101 has a stress-free shape in the form of a dome whereas second filter element 102 is of a planar shape. FIG. 4 shows a cross-sectional view of filter 100 wherein first filter element 101 has a stress-free configuration in the form of peripheral or circular corrugations whereas second filter element 102 has a stress-free shape in the form of radial corrugations and two openings 111. Other geometric stress-free shapes, variations and combinations thereof are also possible without departing from the spirit and scope of the present invention. Similarly, the perimeter of filter 100 may be of any shape, for example, circular, oval, triangular, square or any other shape or combination of shapes as may be desired for or dictated by functional, geometric or aesthetic requirements.

Figure 5:
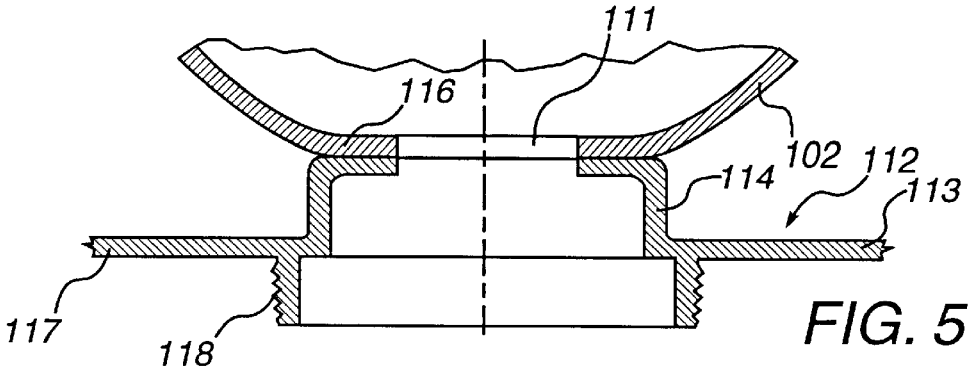
FIG. 5 is a cross-section of the connector for the filter of the present invention.
Figure 6:
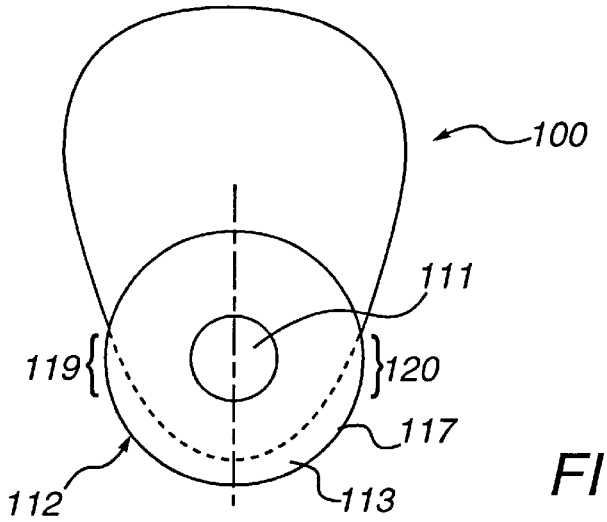
FIG. 6 is a top view of one embodiment of the connector platform and filter of the present invention.
Figure 7:
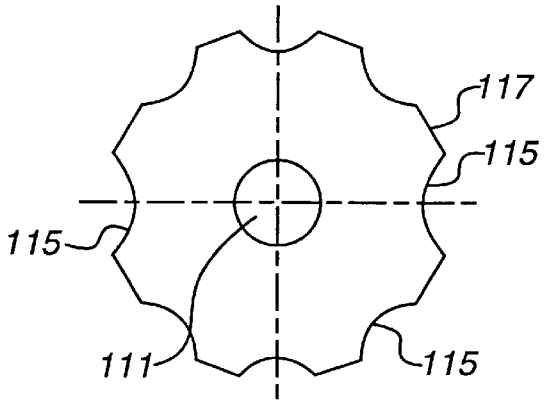
FIG. 7 is a top view of another embodiment of the connector platform of the present invention.
Figure 8:
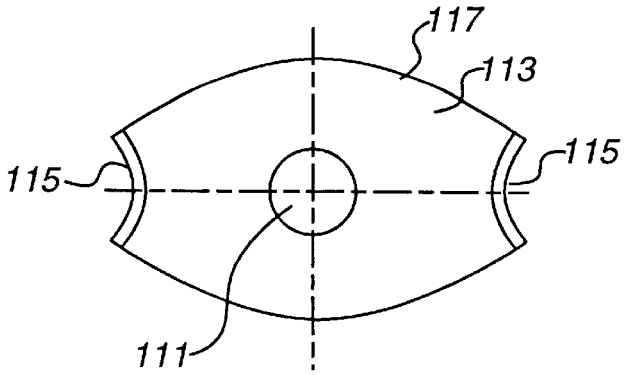
FIG. 8 is a top view of another embodiment of the connector platform of the present invention.

In order to minimize distortion of filter element 100 while attaching opening 111 to a respirator, a connector 112 is provided, shown in cross-sectional view in FIG. 5. As shown therein, connector 112 comprises a connector platform 113, connector opening 114, and an attachment mechanism such, for example, threaded opening 118. Connector opening 114 and filter opening 111 are hermetically joined (permanently or detachably) at joining zone 116. Such a joining may be accomplished by a variety of techniques known in the art, including ultrasonic sealing, snap fit joining, or other methods or techniques. Connector platform perimeter 117 provides access to the fingers of a user's hand to apply the necessary torque or action to connector 112 to attach it to the respiratory facepiece without damaging filter 100 or joining zone 116. FIG. 6 shows a top view of a flexible filter comprising filter 100 having an oval shape, opening 111, connector 112 with a circular connector platform 113 and connector platform perimeter 117. Areas 119 and 120 provide gripping zones for fingers of the user's hand through which the necessary torque or action is applied. In another embodiment of connector platform 113, connector platform perimeter 117 may have finger receiving recesses 115 as shown in FIG. 7. FIG. 8 shows another configuration of connector platform 113 in an elliptical shape with finger gripping recesses 115 located at each end of the ellipse. Other geometric shapes, variations and combinations for connector platform 113, including, but not limited to, triangular, rectangular and square, are also possible without departing from the spirit and scope of the present invention.

While presently preferred embodiments of practicing the invention has been shown and described with particularity in connection with the accompanying drawings, the invention may other wise be embodied within the scope of the following claims.

What is claimed is:

1. A deformable filter comprising: a first filter element having a non-planar configuration in a stress-free condition; a second filter element joined to the first filter element along an outer edge of each to create an inner chamber therebetween, such that air can pass through the first or second filter element and into the inner chamber; and a connector located in and attached to one of the filter elements, the connector having an opening therethrough to permit air to pass from the inner chamber to a respirator facepiece.

2. The filter of claim 1 wherein the inner chamber is filled with a particulate filtration material.

3. The filter of claim 2 wherein the first and second filter elements are non-circular in shape.

4. The filter of claim 1 wherein the first filter element is in the shape of a dome, the second filter element is planar, and the connector is located in the second filter element.

5. The filter of claim 1 wherein the second filter element also has a non-planar configuration in a stress-free condition.

6. The filter of claim 5 wherein the configuration of the first filter element and the second filter element are similar.

7. The filter of claim 5 wherein the configuration of the first filter element and the second filter element are different.

8. The filter element of claim 5 wherein the first filter element has longitudinal corrugations and the second filter element has lateral corrugations.

9. The filter element of claim 5 wherein the first filter element has circular corrugations and the second filter element has radial corrugations.

10. A deformable filter comprising: a first filter element having a non-planar configuration in a stress-free condition; a second filter element joined to the first filter element along an outer edge to create an inner chamber; and a connector located in and attached to one of the filter elements, the connector having an opening therethrough to permit air to pass from the inner chamber to a respirator facepiece, and wherein the connector further comprises a rigid connector platform projecting radially outward from the connector substantially parallel to and spaced apart from the attached filter elements to enable a user's fingers to grasp a perimeter of the connector platform.

11. The filter of claim 10 wherein the connector platform is circular.

12. The filter of claim 11 wherein the perimeter of the connector platform has a plurality of finger-gripping recesses.

13. The filter of claim 10 wherein the connector platform is noncircular.

14. The filter of claim 13 wherein the connector platform is elliptical.

15. The filter of claim 14 wherein the perimeter of the connector platform has a finger-gripping recess at each end of the ellipse.

16. A flexible filter comprising: a first filter element; a second filter element joined to the first filter element along an outer edge to create an inner chamber; and a connector located in and attached to one of the filter elements, the connector having an opening therethrough to permit air to pass from the inner chamber to a respirator facepiece, the connector further comprising a rigid connector platform projecting radially outward from the connector substantially parallel to and spaced apart from the attached filter element to enable a user's fingers to grasp a perimeter of the connector platform.

17. The filter of claim 16 wherein the connector platform is circular and its perimeter has a plurality of finger-gripping recesses.

18. The filter of claim 16 wherein the connector platform is noncircular.

19. The filter of claim 18 wherein the connector platform is elliptical.

20. The filter of claim 19 wherein the perimeter of the connector platform has a finger-gripping recess at each end of the ellipse.

* * * * *